US007535182B2

(12) United States Patent
Lee

(10) Patent No.: US 7,535,182 B2
(45) Date of Patent: May 19, 2009

(54) FLAT PANEL DISPLAY DEVICE HAVING THERMOSTAT

(75) Inventor: Byong Gon Lee, Yongin (KR)

(73) Assignee: Samsung SDI Co., Ltd., Suwon-si (KR)

( * ) Notice: Subject to any disclaimer, the term of this patent is extended or adjusted under 35 U.S.C. 154(b) by 261 days.

(21) Appl. No.: 11/524,234

(22) Filed: Sep. 19, 2006

(65) Prior Publication Data

US 2007/0085813 A1 Apr. 19, 2007

(30) Foreign Application Priority Data

Oct. 18, 2005 (KR) ..... 10-2005-0098332

(51) Int. Cl.
*H01J 13/32* (2006.01)

(52) U.S. Cl. ..... 315/118; 315/169.1; 315/291; 315/224; 345/80; 345/90; 345/101

(58) Field of Classification Search ..... 315/169.1, 315/169.3, 224, 291, 307, 112, 117, 118; 345/75.2, 80, 90, 101; 313/292, 240
See application file for complete search history.

(56) References Cited

U.S. PATENT DOCUMENTS

| | | | | |
|---|---|---|---|---|
| 5,936,354 | A | 8/1999 | Smith et al. | |
| 6,545,500 | B1 * | 4/2003 | Field | 324/770 |
| 2005/0110383 | A1 | 5/2005 | Song et al. | |

FOREIGN PATENT DOCUMENTS

| | | | |
|---|---|---|---|
| EP | 0 686 991 | A1 | 6/1995 |
| JP | 8-321256 | | 12/1996 |
| JP | 9-082246 | | 3/1997 |
| JP | 10-232647 | | 9/1998 |
| JP | 2002-311416 | | 10/2002 |

OTHER PUBLICATIONS

Patent abstracts of Japan for publication No. 09-082246; dated Mar. 28, 1997 in the name of Shigeto Kamata.
Patent abstracts of Japan for publication No. 2002-311416; dated Oct. 23, 2002 in the name of Nobuo Okano.
Patent abstracts of Japan for publication No. 10-232647; dated Sep. 2, 1998 in the name of Taku Sekizawa.
European Search Report dated Mar. 23, 2007, for EP 06 12 2256, in the name of Samsung SDI Co., Ltd.
European Search Report dated May 21, 2007, for EP 06122256.8, in the name of Samsung SDI Co., Ltd.
Patent Abstracts of Japan, Publication No. 08-321256, Published on Dec. 3, 1996, in the name of Tanaka et al.

* cited by examiner

*Primary Examiner*—Haissa Philogene
(74) *Attorney, Agent, or Firm*—Christie, Parker & Hale, LLP

(57) ABSTRACT

A flat panel display device includes an electron emission substrate; an image forming substrate spaced apart from the electron emission substrate; a spacer disposed between the electron emission substrate and the image forming substrate; a detector coupled to the electron emission substrate for detecting a temperature value of the flat panel display device; a temperature controlling part for receiving the receiving the temperature value and for controlling a temperature of the electron emission substrate based on the received temperature value; and a cooler for cooling the flat panel display device to be at the temperature controlled by the temperature controlling part.

19 Claims, 7 Drawing Sheets

MEASURE CURRENT

MEASURE VOLTAGE

FLAT PANEL DISPLAY DEVICE HAVING THERMOSTAT

CROSS-REFERENCE TO RELATED APPLICATION

This application claims priority to and the benefit of Korean Patent Application No. 10-2005-0098332, filed on Oct. 18, 2005, in the Korean Intellectual Property Office, the entire content of which is incorporated herein by reference.

BACKGROUND

1. Field of the Invention

The present invention relates to a flat panel display device having a thermostat.

2. Discussion of Related Art

An electron emission display has a triple electrode structure having a cathode, an anode, and a gate electrode. The cathode electrode serving as a scan electrode is formed on a substrate, an insulator layer having a hole is formed on the cathode electrode, and the gate electrode generally serving as a data electrode is formed on the cathode electrode. Moreover, in the hole, an electron emitter is formed and contacts the cathode electrode.

Such an electron emission display concentrates a high electric field to the emitter to emit electrons due to the quantum mechanical tunnel effect, and the electrons from the emitter are accelerated by voltage applied between the cathode electrode and the anode electrode and collide against an RGB luminescent layer such that a phosphor of the RGB luminescent layer is illuminated to display an image.

FIG. 1 is a schematic view illustrating the uniformity between the pixels of an electron emission display having a conventional resist layer. As shown in FIG. 1, the electron emission display having the resist layer is formed with the resist layer between the cathode electrode and the electron emission source. The resist layer serves as a load to cause a voltage drop (V=IR) proportional to the amount of the transported electrons such that the electron scattering between the electron emission sources is reduced to enhance the uniformity between the pixels.

FIG. 2 is a graph illustrating the relationship between voltage and current of the conventional electron emission display according to whether or not a resist layer exists. As shown in FIG. 2, with the resist layer, in comparison to the case without the resist layer, a driving voltage applied to the electron emission device is inevitably increased, and this serves as a factor to transport more charge and discharge currents and to increase the temperature of the electron emission device.

When temperature increases, resistance decreases, causing the voltage to decrease and the electron emission scattering between the electron emission sources to increase.

Thus, the resistance of the resist layer of the electron emission device cannot be adjusted uniformly and managed steadily during the operation, so that the uniformity between the pixels is affected.

SUMMARY

A flat panel display device includes an electron emission substrate; an image forming substrate spaced apart from the electron emission substrate; a spacer disposed between the electron emission substrate and the image forming substrate; a measuring device including a measuring line formed in a displaying region on the electron emission substrate concurrently with a cathode line, and a first measuring pad formed on a first side and a second measuring pad formed on a second side of a non-displaying region concurrently with a cathode pad; a power supply connected to the first measuring pad to supply a voltage or current thereto; a detector connected to the second measuring pad to detect the voltage or current supplied from the power source; a temperature controlling part for converting the voltage or current detected by the detector into a temperature value and for controlling a temperature of the electron emission substrate; and a cooler for cooling the flat panel display device to be at the temperature controlled by the temperature controlling part.

In one embodiment, the temperature controlling part includes: a temperature converter for converting the voltage or current detected by the detector into the temperature value; a temperature comparator for comparing the temperature value converted by the temperature converter with a reference temperature; and a temperature controller for controlling the temperature of the electron emission substrate.

The detector may be adapted to detect the voltage or current at opposite ends of the measuring line, and the measuring line and the cathode line are formed in the displaying region.

The flat panel display device may also include a second cathode pad formed on the second side of the non-displaying region, wherein the second measuring pad is formed between the cathode pads. The cooler may include a thermoelectric semiconductor device or cooling fan. In one embodiment, the voltage or current supplied to the first measuring pad is supplied during a sensing time when a scan signal is applied to the cathode line.

Another embodiment of a flat panel display device includes an electron emission substrate; an image forming substrate spaced apart from the electron emission substrate; a spacer disposed between the electron emission substrate and the image forming substrate; a measuring device including measuring lines formed in respective corners of a displaying region of the electron emission substrate, and measuring pads connected to ends of the measuring lines in a non-displaying region; a power supply connected to respective first sides of the measuring pads to supply a voltage or current thereto; a detector connected to respective second sides of the measuring pads to detect the voltage or current supplied from the power source; a temperature controlling part for converting the voltage or current detected by the detector into a temperature value and for controlling a temperature of the electron emission substrate; and a cooler for cooling the flat panel display device to be at the temperature controlled by the temperature controlling part.

Yet another flat panel display device includes an electron emission substrate; an image forming substrate spaced apart from the electron emission substrate; a spacer disposed between the electron emission substrate and the image forming substrate; a thermometer or a thermocouple attached to the spacer to measure a temperature value of the electron emission substrate; a temperature controlling part for receiving the temperature value from the thermometer or thermocouple and for controlling a temperature of the electron emission substrate; and a cooler for cooling the flat panel display device to be at the temperature controlled by the temperature controlling part.

Still yet another flat panel display device includes an electron emission substrate; an image forming substrate spaced apart from the electron emission substrate; a spacer disposed between the electron emission substrate and the image forming substrate; a cathode line formed in a displaying region on the electron emission substrate; a first cathode pad formed on a first side and a second cathode pad formed on a second side of a non-displaying region; a power supply connected to the cathode line and the first cathode pad to supply a voltage or current thereto; a detector connected to the cathode line and the second cathode pad to detect the voltage or current supplied from the power source; a temperature controlling part for converting the voltage or current detected by the detector into a temperature value and for controlling a temperature of the electron emission substrate; and a cooler for cooling the flat panel display device to be at the temperature controlled by the temperature controlling part.

The voltage or current supplied to the cathode line may be supplied during a sensing time when a scan signal is applied to the cathode line.

One embodiment of a flat panel display device includes an electron emission substrate; an image forming substrate spaced apart from the electron emission substrate; a spacer disposed between the electron emission substrate and the image forming substrate; a detector coupled to the electron emission substrate for detecting a temperature value of the flat panel display device; a temperature controlling part for receiving the receiving the temperature value and for controlling a temperature of the electron emission substrate based on the received temperature value; and a cooler for cooling the flat panel display device to be at the temperature controlled by the temperature controlling part.

The detector may include a thermometer or thermocouple connected to the spacer for thermally detecting the temperature value.

In one embodiment, the detector includes: a cathode line electrically coupling a first cathode pad and a second cathode pad; a power supply for supplying a voltage or current to the first cathode pad; a voltage or current detector for detecting the voltage or current supplied by the power supply; and a temperature converter for converting the voltage or current detected by the voltage or current detector into the temperature value of the electron emission substrate. The first cathode pad is positioned on a first side and the second cathode pad is positioned on a second side of a non-displaying region of the electron emission substrate and the cathode line is positioned in a displaying region of the electron emission substrate.

In another embodiment, the detector includes: a measuring line electrically coupling a first measuring pad and a second measuring pad; a power supply for supplying a voltage or current to the first measuring pad; a voltage or current detector for detecting the voltage or current supplied by the power supply; and a temperature converter for converting the voltage or current detected by the voltage or current detector into the temperature value of the electron emission substrate. The first measuring pad and the second measuring pad are positioned in a non-displaying region of the electron emission substrate and the measuring line is positioned in a displaying region of the electron emission substrate.

In one embodiment, the first measuring pad is positioned on a first side of the non-displaying region and the second measuring pad is positioned on a second, opposite side of the non-displaying region. Alternatively, the first measuring pad and the second measuring pad may be positioned on a same side of the non-displaying region.

The cooler may include cooling fins. One embodiment of the flat panel display device also includes a temperature comparator for receiving the temperature value, comparing the temperature value to a reference value, and the temperature controlling part controls the temperature of the electron emission substrate based on the comparison.

BRIEF DESCRIPTION OF THE DRAWINGS

These and/or other features and aspects of the invention will become apparent and more readily appreciated from the following description of examples of embodiments, taken in conjunction with the accompanying drawings of which.

DETAILED DESCRIPTION

Hereinafter, a flat panel display device according to examples of embodiments of the present invention will be described with reference to the attached drawings.

Figure 1:
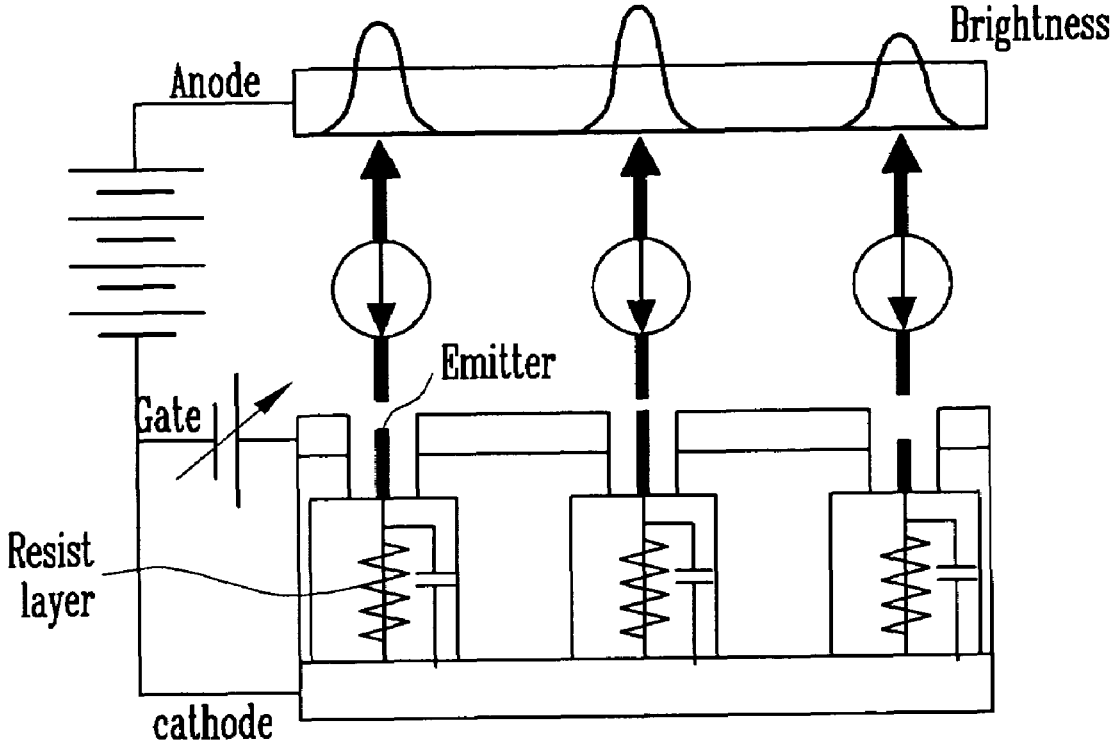
FIG. 1 (PRIOR ART)
FIG. 1 is a schematic view illustrating the uniformity between pixels of an electron emission display having a conventional resist layer.
Figure 1:
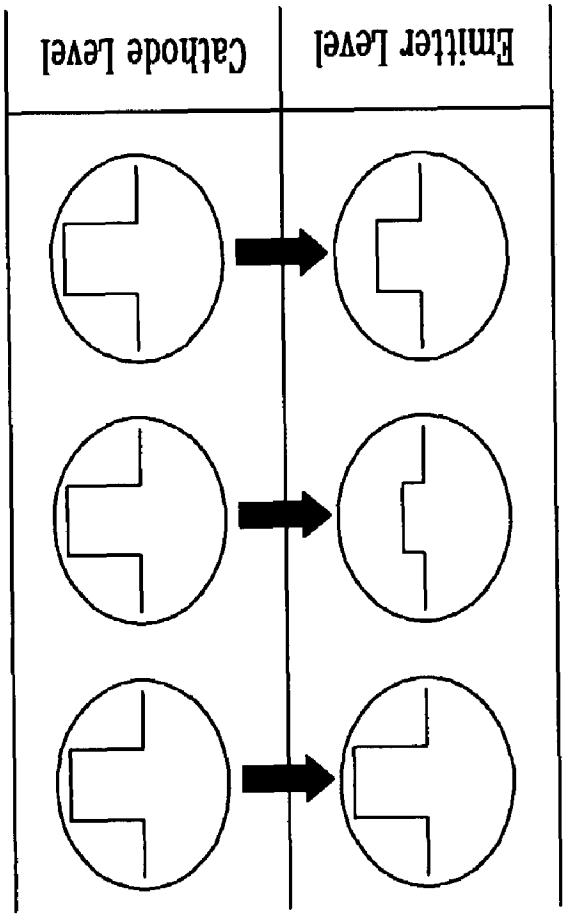
FIG. 1 (PRIOR ART)
Figure 2:
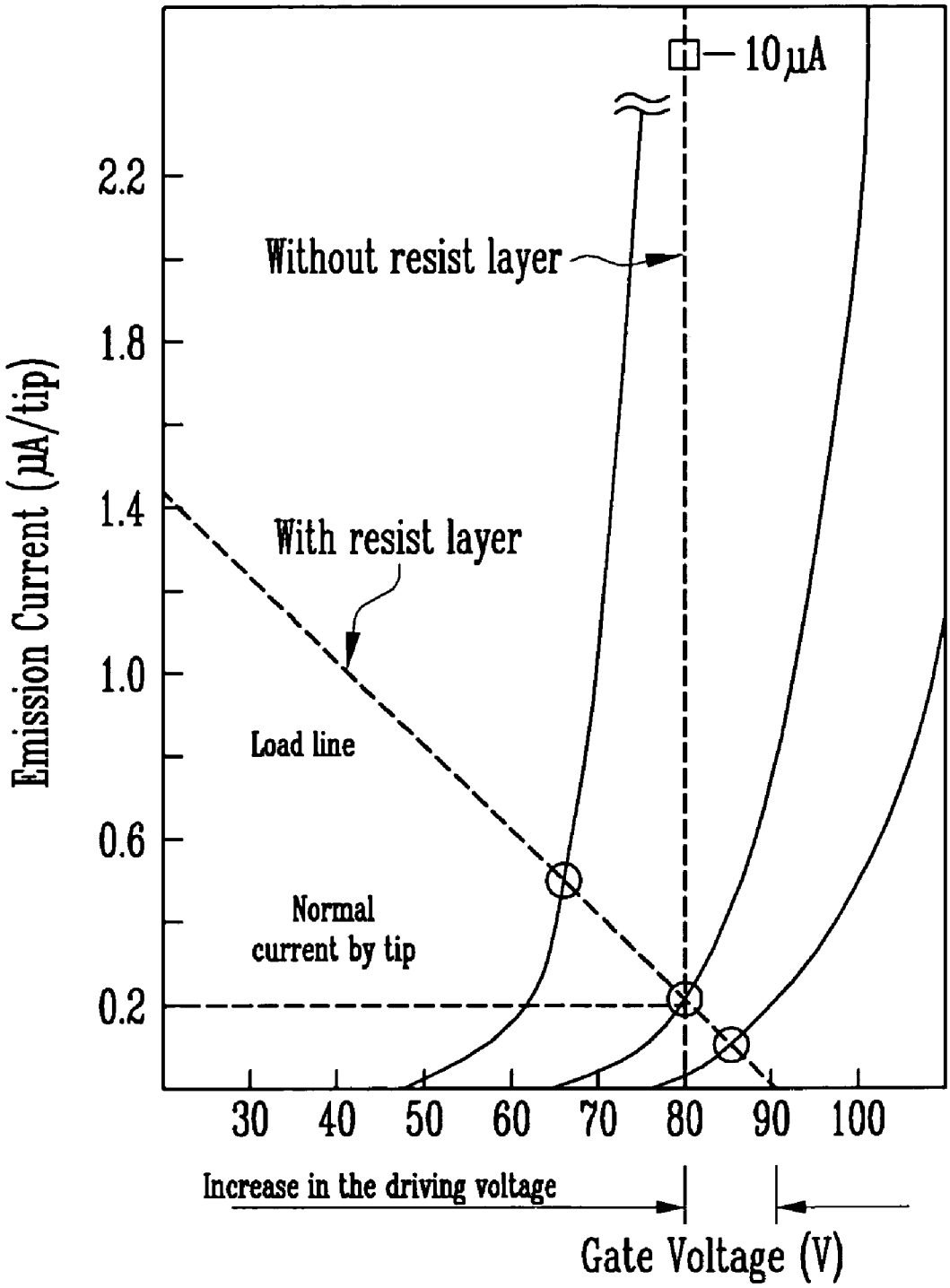
FIG. 2 (PRIOR ART)
FIG. 2 is a graph illustrating the relationship between voltage and current of the conventional electron emission display according to the presence of a resist layer.
Figure 3:
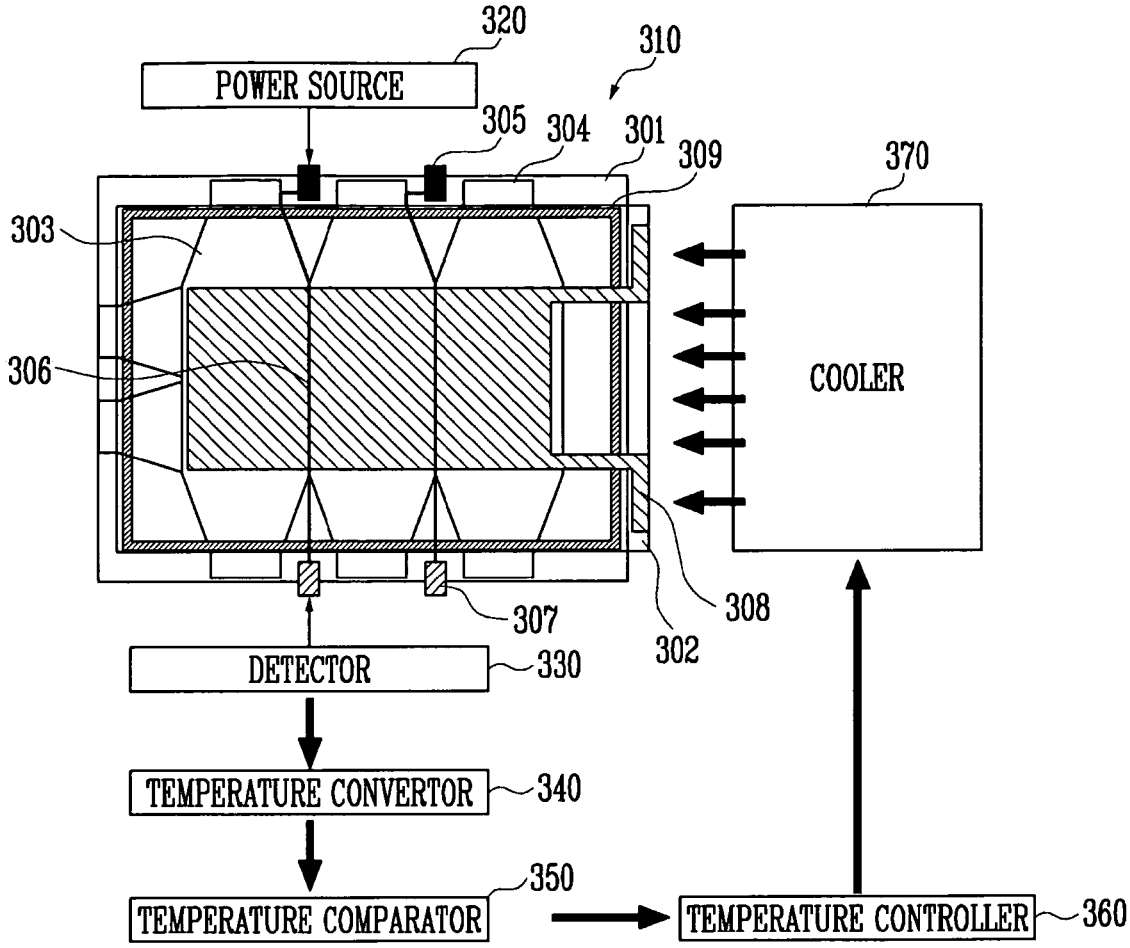
FIG. 3 is a schematic view illustrating a flat panel display device having a thermostat according to an embodiment of the present invention.

As shown in FIG. 3, the flat panel display device 310 according to an embodiment of the present invention includes an electron emission substrate 301, an image forming substrate 302 spaced apart from the electron emission substrate 301, and a spacer (not shown) disposed therebetween. The flat panel display device 310 also includes a measuring device including a measuring line 306 formed in a displaying region on the electron emission substrate 301 with a cathode line 303. In one embodiment, the measuring line and the cathode line are formed concurrently or simultaneously. Measuring pads 305 and 307 are formed in the upper and lower sides of a non-displaying region with a cathode pad 304. In one embodiment, the measuring pads 305 and 307 are formed concurrently or simultaneously with the cathode pad. A power supply 320 is connected to the measuring pad 305 and is formed in the upper side to supply electric power thereto. A detector 330 is connected to the measuring pad 307 and is formed in the lower side to detect a voltage or current supplied from the power source 320. The flat panel display device also includes a temperature converter 340 for converting a voltage detected by the detector 330 into a temperature value, a temperature comparator 350 for comparing the temperature value input from the temperature converter with a reference temperature, a temperature controller 360 for controlling a temperature of the electron emission substrate based on the temperature value compared by the temperature comparator 350 with the reference temperature, and a cooler 370 for cooling the flat panel display device to be at the temperature controlled by the temperature controller 360.

The flat panel display device 310 includes the electron emission substrate 301 spaced apart from the image forming substrate 302 by a distance, which may be predetermined, and a spacer disposed therebetween. The electron emission substrate 301 of the flat panel display device 310 includes the cathode line 303 having a desired shape, for example, a stripe shape, and formed in a display region on a transparent substrate. The electron emission device includes an electron emitter (not shown) formed at a crossing of the cathode line 303 and the gate line. The cathode line 303 becomes a cathode electrode of the electron emission device and is formed using indium tin oxide (ITO) in one embodiment. At that time, the cathode line 303 and the measuring line 306 of the measuring device are formed concurrently or simultaneously in this embodiment.

Moreover, a resist layer (not shown) is further formed between the cathode electrode and the electron emitter.

In the non-displaying region of the electron emission substrate 301, the cathode pad 304 is formed to supply signals to the cathode line 303. At that time, in a desired region between the cathode pads 304, the measuring pads 305 and 307 of the measuring device are formed simultaneously.

Additionally, the image forming substrate 302 includes a transparent substrate, the anode electrode 308 formed on the transparent substrate, phosphors (not shown) formed on the anode electrode 308 to emit light due to electrons emitted from the electron emitter, and a light shield layer (not shown) formed between the phosphors.

The flat panel display device 310 further includes a frit 309 for sealing the electron emission substrate 301 and the image forming substrate 302 to maintain a vacuum thereof and for supporting the two substrates.

The measuring device includes the measuring line 306 formed in the displaying region like the cathode line 303, and the measuring pads 305 and 307 formed in the upper and lower sides of the non-displaying region like the cathode pad 304 and between the cathode pads 304. The measuring pads 305 and 307 are connected to respective ends of the measuring line 306.

The power source 320 supplies electric power to the measuring pad 305 connected to the upper end of the measuring line 306. At that time, the power source can operate as a current source or a voltage source to the measuring pad 305.

Figure 4A:
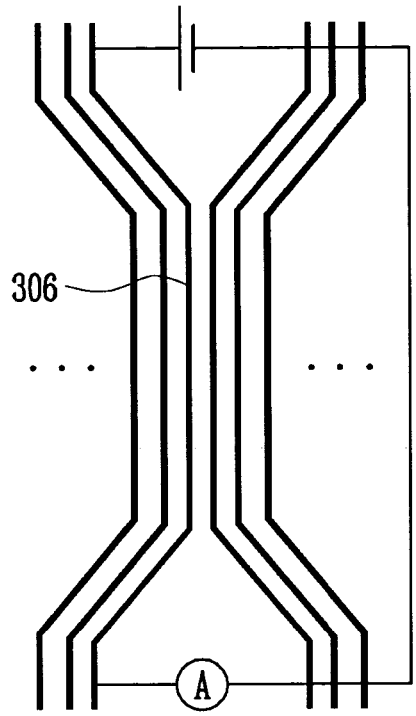
FIGS. 4A and 4B are schematic views illustrating a voltage applied to a measuring device used in an embodiment of the present invention.
Figure 4B:
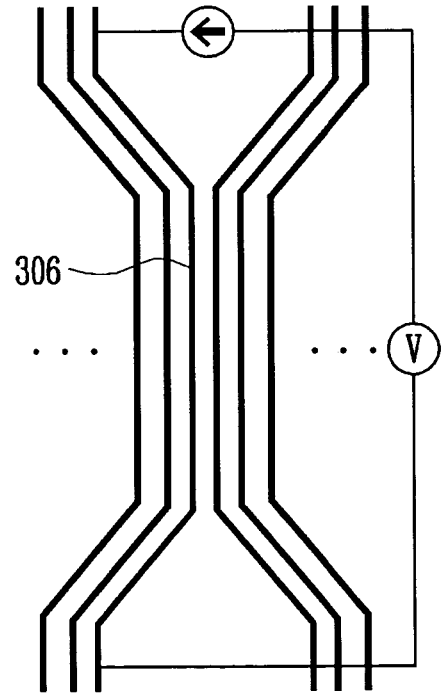

FIGS. 4A and 4B are schematic views illustrating a voltage applied to a measuring device used in one embodiment of the present invention. As shown in FIGS. 3 and 4A, the measuring pad 305 connected to the end of the measuring line 306 of the measuring device measures a current difference between two ends of the measuring pad 307 connected to the opposite end of the measuring line 306 with respect to the voltage source.

As shown in FIGS. 3 and 4B, current is applied to the measuring pad 305 connected to the end of the measuring line 306 of the measuring device such that the measuring pad 307 connected to the opposite end of the measuring line 306 measures the voltage difference between both ends with respect to the current source.

In other words, the current of the measuring device passing through the electron emission substrate 301 can be measured with reference to the voltage source of the power source 320, and the voltage of the measuring device can be measured with reference to the current source.

The detector 330 detects current or voltage between both ends of the measuring line after the current or the voltage supplied from the power source 320 has passed through the measuring device.

Figure 5:
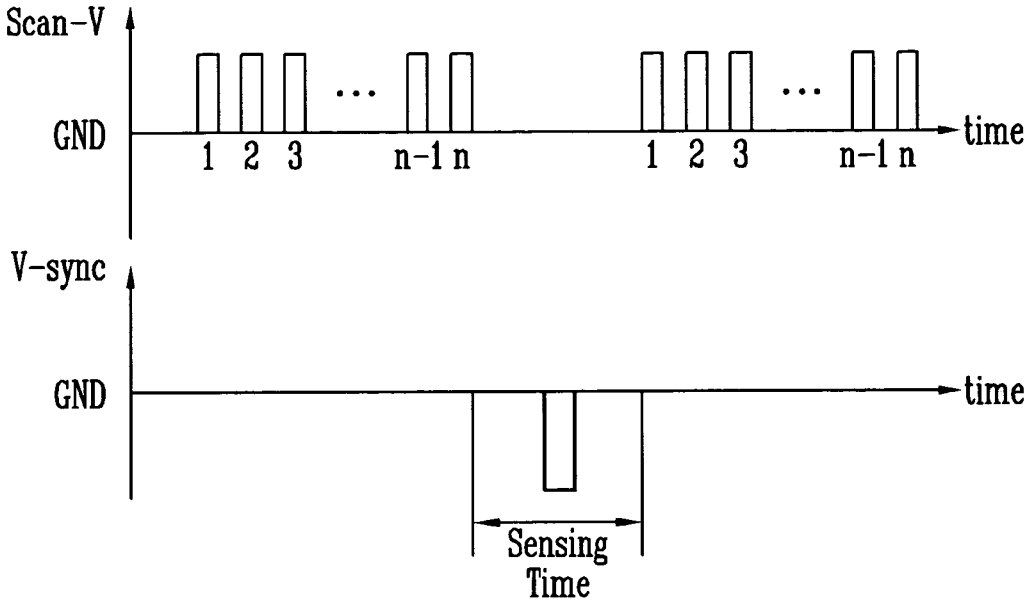
FIG. 5 is a view illustrating a measuring interval of one embodiment of a measuring device according to the present invention.

FIG. 5 is a view illustrating a measuring interval of the measuring device according to an embodiment of the present invention. As shown in FIGS. 3 and 5, the measurement of a current difference or a voltage difference between two ends of the measuring device is performed only at a predetermined time. In other words, since the measuring line 306 is formed in the displaying region, the differences are measured to avoid overlap with the time when a scan signal Scan-V is applied by the cathode line 303. Here, since the scan signal Scan-V applied through the cathode line 303 is applied with reference to a synchronizing signal V-sync, the differences are measured at a sensing time of the scan signal Scan-V.

The temperature converter 340 converts the current or the voltage detected by the detector 330 into a temperature value. Here, the detected current or voltage can be obtained from a table presetting the relationship between current or voltage and temperature. Thus, when a certain current or voltage is detected, the temperature converter converts the detected value into a corresponding temperature value.

The temperature comparator 350 determines whether the temperature value converted by the temperature converter 340 corresponds to the reference temperature of the electron emission substrate 301. In other words, it is compared and determined whether or not the temperature value of the electron emission substrate 301 is over the reference temperature.

When the temperature comparator 350 determines that the temperature of the electron emission substrate is increased, the temperature controller 360 outputs a driving signal to decrease the temperature to below the reference temperature so that current is prevented from decreasing due to an increase of resistance of the resist layer of the electron emission substrate.

The cooler 370 cools the electron emission substrate such that temperature of the electron emission substrate is decreased according to the driving signal output by the temperature controller 360.

The cooler 370 may include cooling fins or a cooling fan installed on the rear side of the electron emission substrate or may include a thermoelectric semiconductor using the Peltier effect and deposited on the rear side of the electron emission substrate.

Figure 6:
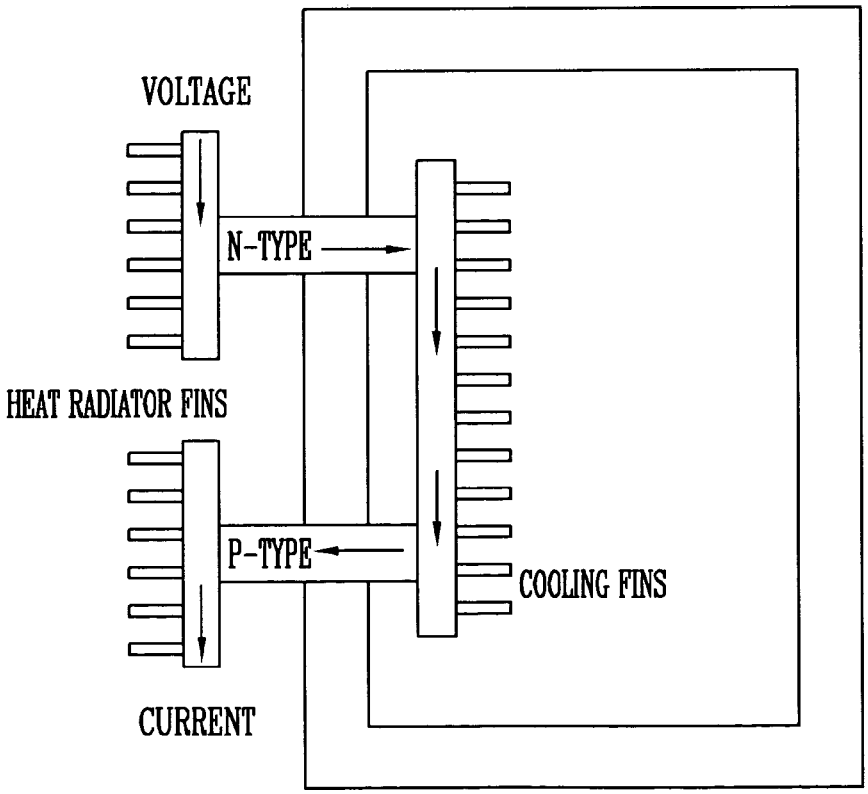
FIG. 6 is a schematic view illustrating a thermoelectric semiconductor of a cooler according to an embodiment of the present invention.

FIG. 6 is a schematic view illustrating the thermoelectric semiconductor of the cooler according to an embodiment of the present invention. As shown in FIG. 6, the thermoelectric semiconductor may be a P-type or N-type semiconductor. When current is applied from the N-type semiconductor to the P-type semiconductor, the cooling fins on one side are cooled and radiator fins formed on the opposite side emit heat.

Specifically, when current is applied to a closed circuit including a semiconductor connected to two different metals, heat different from Joule's heat is generated or absorbed at the junction. This phenomenon is called to Peltier effect.

The Peltier effect refers to the heat emission or heat absorption occurring when current flows through the junction between two different materials. If heat is generated when current flows in one direction, heat is absorbed when the current flows in the opposite direction. The Peltier effect is reversible. In other words, when current flows in the opposite direction, heat generation and heat absorption reverse. For example, when iron and copper are connected to the ends and current flows therethrough, heat is generated from a junction and heat is absorbed from the exterior of the opposite junction so that ambient temperature decreases.

Heat absorbed and emitted due to the Peltier effect can be expressed by the following formula.

$$|Qp| = \alpha ab \times Tj \times I = \pi \times I$$

Here, $\pi = \alpha ab \times Tj$ is a Pelter coefficient, I is current, $\alpha ab$ is relative thermoelectric power of two metals a and b according to ambient temperature, and |Qp| is an absolute value of heat generated in a unit time.

When the current of the Peltier thermoelectric semiconductor is applied in the opposite direction, the cooling fins serve as a heat radiator pad and the heat radiator fins serve as a cooling pad.

In the embodiment shown in FIG. 3, the temperature of the electron emission substrate is measured and the substrate is cooled to maintain the measured temperature at the reference value so that the resistance of the electron emission substrate can be maintained and the uniformity between the pixels can also be maintained.

Figure 7:
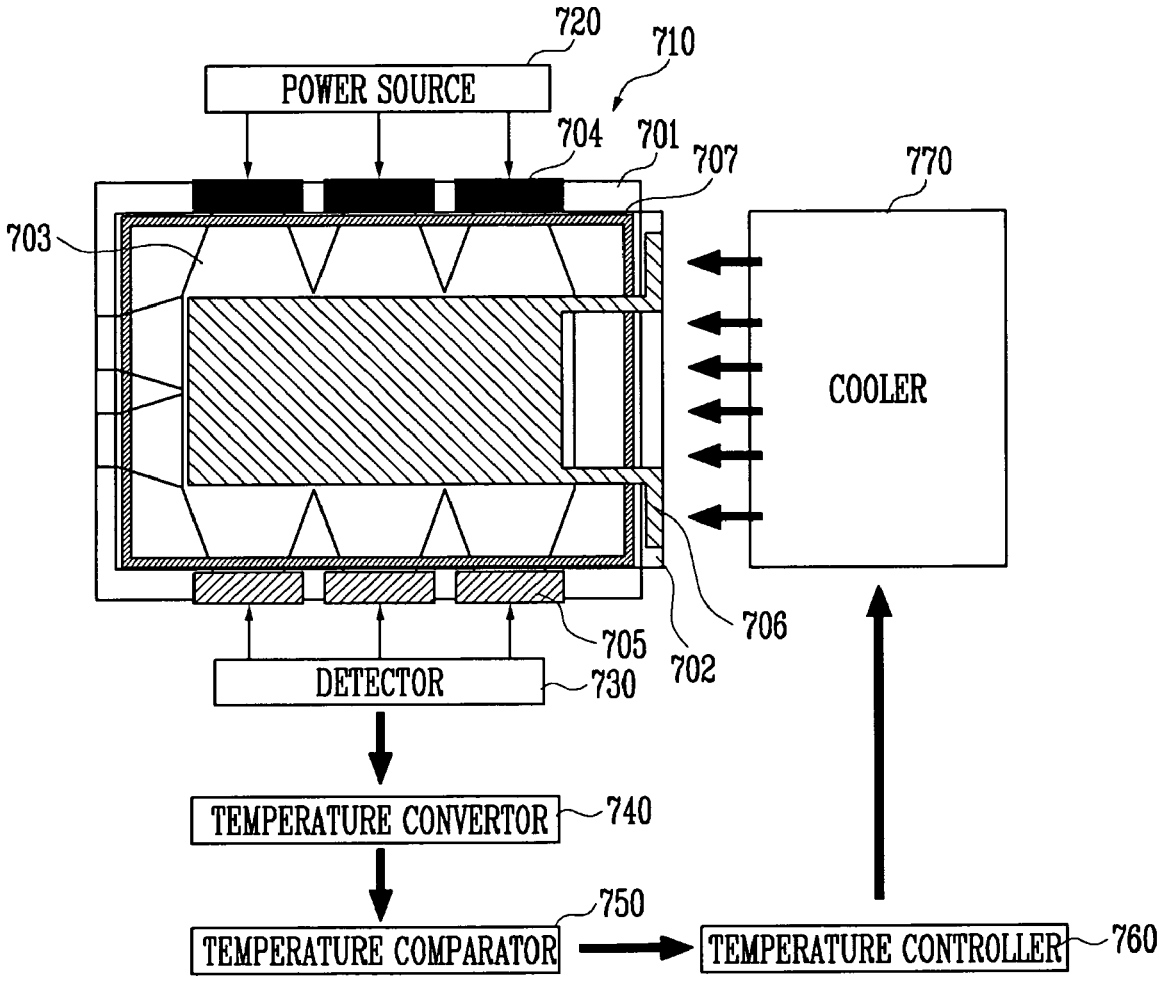
FIG. 7 is a view illustrating a flat panel display device having a thermostat according to another embodiment of the present invention.

FIG. 7 is a view illustrating a flat panel display device having a thermostat according to another embodiment of the present invention. As shown in FIG. 7, the flat panel display device 710 having a thermostat includes an electron emission substrate 701, an image forming substrate 702 spaced apart from the electron emission substrate 701, and a spacer disposed therebetween. The flat panel display device 710 further includes a cathode line 703 formed in a displaying region serving as a measuring device on the electron emission substrate 701, and cathode pads 704 and 705 formed in the upper and lower sides of a non-displaying region. The flat panel display device also includes a power source 720 connected to the cathode pad 704 formed in the upper side to supply electric power and a detector 730 connected to the cathode pad formed in the lower side to detect electric power supplied from the power source 720. A temperature converter 740 is also included for converting the current or voltage detected by the detector 730 into a temperature value along with a comparator 750 for comparing the temperature value input from the temperature converter 740 with a reference temperature, a temperature controller 760 for controlling the temperature of the electron emission substrate based on the comparison by the temperature comparator 750 with the reference temperature, and a cooler 770 for cooling the electron emission substrate to be at the temperature controlled by the temperature controller 760.

Additional description of elements similar to those discussed above in reference to FIG. 3 will be omitted.

In the embodiment shown in FIG. 7, the cathode pads 704 and 705 and the cathode line 703 can be used without a measuring device so that temperature of all devices in the cathode line in every region can be independently monitored. In other words, temperature of the cathode line can be finely adjusted in every region.

Figure 8:
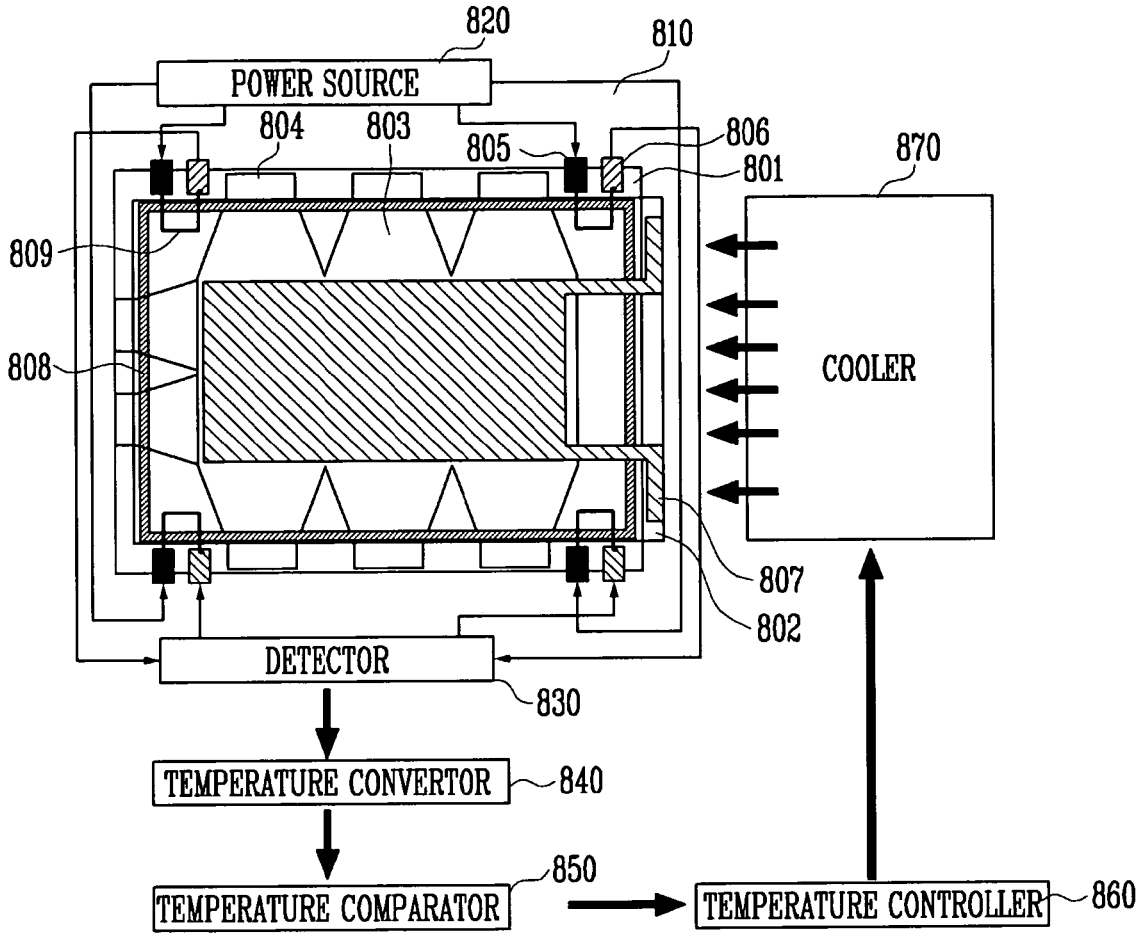
FIG. 8 is a view illustrating a flat panel display device according to yet another embodiment of the present invention.

FIG. 8 is a view illustrating a flat panel display device according to yet another embodiment of the present invention. As shown in FIG. 8, the flat panel display device 810 includes an electron emission substrate 801, an image forming substrate 802 spaced apart from the electron emission substrate 801, and a spacer disposed therebetween. The flat panel display device 810 further includes a measuring device having a measuring line 809 formed in every corner of a displaying region of the electron emission substrate 801 and measuring pads 805 and 806 connected to ends of the measuring line 809 in a non-displaying region. The flat panel display device 810 also includes a power source 820 connected to the measuring pad 805 to supply electric power and a detector 830 connected to the opposite end of the measuring pad 806 to detect the voltage or current supplied from the power source 820. Also included in the display are a temperature converter 840 for converting the voltage or current detected by the detector 830 into a temperature value, a comparator 850 for comparing the temperature value input from the temperature converter 840 with a reference temperature, a temperature controller 860 for controlling the temperature of the electron emission substrate based on the comparison by the temperature comparator 850 with the reference temperature, and a cooler 8770 for cooling the electron emission substrate to be at the temperature controlled by the temperature controller 860.

Additional description of elements similar to those described above in relation to FIGS. 3 and 7 will be omitted.

This structure allows to easily design the measuring device without changing the design of the displaying region.

Although the measuring device is formed to measure temperature in the described embodiments, a device for measuring temperature of the electron emission substrate may include a thermometer or thermocouple. In other words, a small thermometer or thermocouple may be attached to the spacer formed between the electron emission substrate and the image forming substrate to measure temperature.

Although only some examples of embodiments of the present invention have been disclosed for illustrative purposes, those skilled in the art will appreciate that various modifications, additions and substitutions are possible, without departing from the scope and spirit of the invention as defined in the accompanying claims and their equivalents.

What is claimed is:

1. A flat panel display device comprising:

an electron emission substrate;

an image forming substrate spaced apart from the electron emission substrate;

a spacer disposed between the electron emission substrate and the image forming substrate;

a measuring device including a measuring line formed in a displaying region on the electron emission substrate concurrently with a cathode line, and a first measuring pad formed on a first side and a second measuring pad formed on a second side of a non-displaying region concurrently with a cathode pad;

a power supply connected to the first measuring pad to supply a voltage or current thereto;

a detector connected to the second measuring pad to detect the voltage or current supplied from the power source;

a temperature controlling part for converting the voltage or current detected by the detector into a temperature value and for controlling a temperature of the electron emission substrate; and a cooler for cooling the flat panel display device to be at the temperature controlled by the temperature controlling part.

2. The flat panel display device as claimed in claim 1, wherein the temperature controlling part comprises:

a temperature converter for converting the voltage or current detected by the detector into the temperature value;

a temperature comparator for comparing the temperature value converted by the temperature converter with a reference temperature; and a temperature controller for controlling the temperature of the electron emission substrate.

3. The flat panel display device as claimed in claim 1, wherein the detector is adapted to detect the voltage or current at opposite ends of the measuring line.

4. The flat panel display device as claimed in claim 1, wherein the measuring line and the cathode line are formed in the displaying region.

5. The flat panel display device as claimed in claim 1, further comprising a second cathode pad formed on the second side of the non-displaying region, wherein the second measuring pad is formed between the cathode pads.

6. The flat panel display device as claimed in claim 1, wherein the cooler comprises a thermoelectric semiconductor device or a cooling fan.

7. The flat panel display device as claimed in claim 1, wherein the voltage or current supplied to the first measuring pad is supplied during a sensing time when a scan signal is applied to the cathode line.

8. A flat panel display device comprising:

an electron emission substrate;

an image forming substrate spaced apart from the electron emission substrate;

a spacer disposed between the electron emission substrate and the image forming substrate;

a measuring device including measuring lines formed in respective corners of a displaying region of the electron emission substrate, and measuring pads connected to ends of the measuring lines in a non-displaying region;

a power supply connected to respective first sides of the measuring pads to supply a voltage or current thereto;

a detector connected to respective second sides of the measuring pads to detect the voltage or current supplied from the power source;

a temperature controlling part for converting the voltage or current detected by the detector into a temperature value and for controlling a temperature of the electron emission substrate; and a cooler for cooling the flat panel display device to be at the temperature controlled by the temperature controlling part.

9. A flat panel display device comprising:

an electron emission substrate;

an image forming substrate spaced apart from the electron emission substrate;

a spacer disposed between the electron emission substrate and the image forming substrate;

a thermometer or a thermocouple to measure a temperature value of the electron emission substrate;

a temperature controlling part for receiving the temperature value from the thermometer or thermocouple and for controlling a temperature of the electron emission substrate based on a comparison of the received temperature value to a reference value; and a cooler for cooling the flat panel display device to be at the temperature controlled by the temperature controlling part.

10. A flat panel display device comprising:

an electron emission substrate;

an image forming substrate spaced apart from the electron emission substrate;

a spacer disposed between the electron emission substrate and the image forming substrate;

a cathode line formed in a displaying region on the electron emission substrate;

a first cathode pad formed on a first side and a second cathode pad formed on a second side of a non-displaying region;

a power supply connected to the cathode line and the first cathode pad to supply a voltage or current thereto;

a detector connected to the cathode line and the second cathode pad to detect the voltage or current supplied from the power source;

a temperature controlling part for converting the voltage or current detected by the detector into a temperature value and for controlling a temperature of the electron emission substrate; and a cooler for cooling the flat panel display device to be at the temperature controlled by the temperature controlling part.

11. The flat panel display device as claimed in claim 10, wherein the voltage or current supplied to the cathode line is supplied during a sensing time when a scan signal is applied to the cathode line.

12. A flat panel display device comprising:

an electron emission substrate;

an image forming substrate spaced apart from the electron emission substrate;

a spacer disposed between the electron emission substrate and the image forming substrate;

a detector coupled to the electron emission substrate for detecting a temperature value of the flat panel display device;

a temperature controlling part for receiving the temperature value and for controlling a temperature of the electron emission substrate based on a comparison of the received temperature value to a reference value; and a cooler for cooling the flat panel display device to be at the temperature controlled by the temperature controlling part.

13. The flat panel display device of claim 12, wherein the detector comprises a thermometer or thermocouple for thermally detecting the temperature value.

14. The flat panel display device of claim 12, wherein the detector comprises:

a cathode line electrically coupling a first cathode pad and a second cathode pad;

a power supply for supplying a voltage or current to the first cathode pad;

a voltage or current detector for detecting the voltage or current supplied by the power supply; and a temperature converter for converting the voltage or current detected by the voltage or current detector into the temperature value of the electron emission substrate, wherein the first cathode pad is positioned on a first side and the second cathode pad is positioned on a second side of a non-displaying region of the electron emission substrate and the cathode line is positioned in a displaying region of the electron emission substrate.

15. The flat panel display device of claim 12, wherein the detector comprises:

a measuring line electrically coupling a first measuring pad and a second measuring pad;

a power supply for supplying a voltage or current to the first measuring pad;

a voltage or current detector for detecting the voltage or current supplied by the power supply; and a temperature converter for converting the voltage or current detected by the voltage or current detector into the temperature value of the electron emission substrate, wherein the first measuring pad and the second measuring pad are positioned in a non-displaying region of the electron emission substrate and the measuring line is positioned in a displaying region of the electron emission substrate.

16. The flat panel display device of claim 15, wherein the first measuring pad is positioned on a first side of the non-displaying region and the second measuring pad is positioned on a second, opposite side of the non-displaying region.

17. The flat panel display device of claim 15, wherein the first measuring pad and the second measuring pad are positioned on a same side of the non-displaying region.

18. The flat panel display device of claim 12, wherein the cooler comprises cooling fins.

19. The flat panel display device of claim 12, wherein the temperature controlling part comprises a temperature comparator for the receiving the temperature value and the comparison of the received temperature value to a reference value.

* * * * *